US011002454B2

(12) United States Patent
Brahme et al.

(10) Patent No.: US 11,002,454 B2
(45) Date of Patent: May 11, 2021

(54) DETECTION OF REFRIGERANT SIDE FAULTS

(71) Applicant: Lennox Industries Inc., Richardson, TX (US)

(72) Inventors: Amita Brahme, Dallas, TX (US); Umesh Gokhale, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 110 days.

(21) Appl. No.: 16/519,212

(22) Filed: Jul. 23, 2019

(65) Prior Publication Data

US 2021/0025610 A1 Jan. 28, 2021

(51) Int. Cl.

*F24F 11/38* (2018.01)
*F24F 11/63* (2018.01)
*F24F 11/49* (2018.01)

(52) U.S. Cl.

CPC ..... *F24F 11/38* (2018.01); *F24F 11/49* (2018.01); *F24F 11/63* (2018.01)

(58) Field of Classification Search

CPC .. F24F 11/38; F24F 11/49; F24F 11/63; F24F 2110/12; F25B 2313/0293; F25B 2600/025; F25B 2600/05; F25B 2700/21163

See application file for complete search history.

(56) References Cited

U.S. PATENT DOCUMENTS 9,759,465 B2 * 9/2017 Schuster ..... F25B 45/00
10,203,140 B2 * 2/2019 Kopko ..... F25B 43/02
2005/0257543 A1 * 11/2005 Martin ..... B60H 1/3205 62/228.1
2006/0112702 A1 * 6/2006 Martin ..... B60H 1/00378 62/180
2011/0023515 A1 * 2/2011 Kopko ..... F28F 1/022 62/222
2013/0160470 A1 * 6/2013 Schuster ..... F25B 45/00 62/77
2020/0393151 A1 * 12/2020 Goel ..... F25B 49/02

FOREIGN PATENT DOCUMENTS

JP WO2012172611 A1 * 2/2015 ..... F25B 49/02
JP 5975937 B2 * 8/2016 ..... F24F 11/30

* cited by examiner

*Primary Examiner* — Nelson J Nieves
(74) *Attorney, Agent, or Firm* — Baker Botts L.L.P.

(57) ABSTRACT

An HVAC system includes a controller communicatively coupled to a subcool sensor, an outdoor temperature sensor, a compressor, and a blower of the HVAC system. For a first period of time, the controller periodically determines subcool values. For each determined subcool value, a corresponding compressor speed, outdoor temperature, and blower speed are determined. A baseline database is generated with baseline values associated with normal operation of the HVAC system. Following the first period of time, subcool values are determined based on the subcool signal. For each subcool value, a corresponding compressor speed, outdoor temperature, and blower speed are determined. The controller determines whether each subcool value satisfies a criteria based on the baseline database. If the criteria are not satisfied for at least a threshold time, the system is determined to be operating under a fault condition, and a corresponding alert is transmitted.

20 Claims, 5 Drawing Sheets

200

204

202

Blower Speed = Normal

| Outdoor Temperature (°F) | Compressor Speed (Hz) | | | | | | | | | | | | |
|---|---|---|---|---|---|---|---|---|---|---|---|---|---|
| | 22-25 | 26-28 | 29-31 | 32-34 | 35-37 | 38-40 | 41-43 | 44-46 | 47-49 | 50-52 | 53-55 | 56-58 |
| 70-74 | | | | | | | | | | | | |
| 75-78 | | | | | | | | | | | | |
| 79-82 | 3.19 °F | | | | | | | | | | | |
| 83-86 | 3.10 °F | 3.23 °F | | | | | | | | | | |
| 87-90 | | 3.08 °F | 3.26 °F | 3.37 °F | 3.45 °F | | | | | | | |
| 91-94 | 2.89 °F | 3.03 °F | 3.17 °F | 3.27 °F | 3.35 °F | 3.61 °F | 4.10 °F | 4.35 °F | 4.86 °F | | | |
| 95-98 | | | 3.07 °F | 3.26 °F | 3.31 °F | 3.54 °F | 3.77 °F | 3.88 °F | 4.40 °F | 4.94 °F | 5.17 °F | 6.36 °F |
| 99-102 | | | | | | | | | | | 4.63 °F | 5.80 °F |

*FIG. 2A*

250

| Blower Speed = Low | | | | | | | | | | | | | |
|---|---|---|---|---|---|---|---|---|---|---|---|---|---|
| | Compressor Speed (Hz) | | | | | | | | | | | | |
| Outdoor Temperature (°F) | 22-25 | 26-28 | 29-31 | 32-34 | 35-37 | 38-40 | 41-43 | 44-46 | 47-49 | 50-52 | 53-55 | 56-58 |
| 70-74 | | | | | | | | | | | | |
| 75-78 | | | | | | | | | | | | |
| 79-82 | | | | | | | | | | | | |
| 83-86 | | 3.31 °F | | | | | | | | | | |
| 87-90 | 2.98 °F | 3.18 °F | 3.37 °F | 3.44 °F | 3.55 °F | | | | | | | |
| 91-94 | 2.91 °F | 3.07 °F | 3.24 °F | 3.31 °F | 3.44 °F | 3.76 °F | 4.28 °F | 4.80 °F | | | | |
| 95-98 | | | 3.08 °F | 3.26 °F | 3.38 °F | 3.69 °F | 4.04 °F | 4.55 °F | 5.07 °F | 5.40 °F | 5.65 °F | |
| 99-102 | | | | | | | | | | | | 6.16 °F |

*FIG. 2B*

DETECTION OF REFRIGERANT SIDE FAULTS

TECHNICAL FIELD

The present disclosure relates generally to heating, ventilation, and air conditioning (HVAC) systems and methods of their use. In certain embodiments, the present disclosure relates to detection of refrigerant side faults.

BACKGROUND

Heating, ventilation, and air conditioning (HVAC) systems are used to regulate environmental conditions within an enclosed space. Typically, HVAC systems include both an evaporator coil and a condenser coil. A blower of the HVAC system pulls warm air from the enclosed space and pushes the air across the evaporator coil to cool the air. The air is cooled via heat transfer with refrigerant flowing through the evaporator coil and returned to the enclosed space as conditioned air. Meanwhile, the refrigerant flowing through the evaporator is heated and generally transitions to the vapor phase. After being pressurized by a compressor, the refrigerant from the evaporator coil flows toward the condenser coil where it is cooled before flowing back to the evaporator coil to repeat the cycle.

SUMMARY OF THE DISCLOSURE

In an embodiment, an HVAC system includes a controller communicatively coupled to a subcool sensor, an outdoor temperature sensor, a compressor, and a blower of the HVAC system. For a first period of time, the controller periodically determines subcool values based on the subcool signal provided by the subcool sensor. For each determined subcool value, a corresponding compressor speed, outdoor temperature, and blower speed are determined. A baseline database is generated with baseline values associated with normal operation of the HVAC system. Each baseline value corresponds to a mean subcool value determined for a corresponding bin of the baseline database. Each bin corresponds to a predefined range of outdoor temperatures, a predefined range of compressor speeds, and a predefined range of blower speeds. Following the first period of time, the controller periodically determines subcool values based on the subcool signal provided by the subcool sensor. For each determined subcool value, the corresponding compressor speed, outdoor temperature, and blower speed are determined. For each determined subcool value, the controller determines whether the subcool value satisfies a criteria based on the baseline value for the bin associated with the outdoor temperature, compressor speed, and blower speed corresponding to the subcool value. Responsive to a determination that the criteria are not satisfied for at least a threshold time, the HVAC system is determined to be operating under a fault condition, and a corresponding alert is transmitted.

Conventional approaches to detecting HVAC system faults, such as an undercharge or overcharge of refrigerant, generally rely on an individual associated with the system recognizing a loss of system performance. For example, an occupant of an enclosed space being conditioned by an HVAC system may recognize that the space is not comfortable or is not reaching a desired temperature setpoint. Conventional approaches result in delayed detection of system faults, such that it may be too late to take efficient and effective corrective action once a fault is identified. For instance, by the time a fault is detected using conventional approaches, damage may have occurred to system components, resulting in a need for repairs which may be costly, complex, or even impossible. Conventional approaches may also result in false positive identification of faults, such that a fault appears to have occurred but actually has not. This can result in a waste of resources as part of attempts to diagnose and correct a non-existent fault.

The unconventional HVAC system contemplated in the present disclosure solves problems of previous systems, including those described above, by providing systems and methods for detecting system faults (e.g., overcharge or undercharge of refrigerant, e.g., a faulty expansion valve or other system component). The present disclosure encompasses the recognition that system-specific baseline performance characteristics can be recorded over discrete ranges of operating parameters and used to accurately and effectively detect system faults. For example, properties (or changes in properties) of both the refrigerant flowing through various portions of an HVAC system (e.g., in or around the condenser and evaporator of the HVAC system) and of other parameters associated with the HVAC system (e.g., outdoor temperature, compressor speed, and/or blower speed) can impact HVAC system performance. The systems and methods of the present disclosure account for the effects of these various properties and system parameters to more accurately and effectively detect system faults in a system-specific manner with fewer false positives than was possible using previous technology, thereby improving the operation of HVAC systems.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which:

FIGS. 2A-B are example tables of the baseline database of FIG. 1;

DETAILED DESCRIPTION

Embodiments of the present disclosure and its advantages are best understood by referring to FIGS. 1 through 4 of the drawings, like numerals being used for like and corresponding parts of the various drawings.

As used in the present disclosure, a "saturated liquid" refers to a fluid in the liquid state that is in thermodynamic equilibrium with the vapor state of the fluid for a given pressure. A "saturated liquid" is said to be at the saturation temperature for a given pressure. If the temperature of a saturated liquid is increased above the saturation temperature, the saturated liquid generally begins to vaporize. A "superheated vapor" refers to a fluid in the vapor state that is heated to a temperature that is greater than the saturation temperature of the fluid at a given pressure. A "subcooled liquid" refers to a fluid in the liquid state that is cooled below the saturation temperature of the fluid at a given pressure.

As used in the present disclosure, a "superheat value" is generally the temperature difference between the temperature of superheated vapor refrigerant associated with an evaporator (e.g., the "suction temperature") and the saturation temperature of the refrigerant associated with the evaporator (e.g., the "saturated suction temperature"). As used in the present disclosure, a "subcool value" is generally the temperature difference between the saturation temperature of refrigerant associated with a condenser of an HVAC system (e.g., refrigerant flowing in the condenser or in an outlet line of the condenser) and the temperature of the subcooled liquid refrigerant flowing through the condenser of the HVAC system.

As described above, prior to the present disclosure, there was a lack of tools for effectively detecting HVAC system faults, particularly with a low level of false-positive fault determinations. The systems and methods described herein provide solutions to these problems by facilitating the detection of system faults using a baseline database, which may be created for each HVAC system, as deployed, to characterize the normal operation of the HVAC system. For example, a baseline database may store baseline values corresponding to mean subcool values that are "binned" according to other operating parameters or characteristics of the HVAC system (e.g., compressor speed, outdoor temperature, and blower speed, as shown in the examples of FIGS. 2A-B). The baseline database facilitates the more effective determination of departures from normal baseline operation even when other operating properties or characteristics of the HVAC system change during operation of the HVAC system (e.g., if one or more of the outdoor temperature, compressor speed, and/or blower speed changes during system operation).

HVAC System

Figure 1:
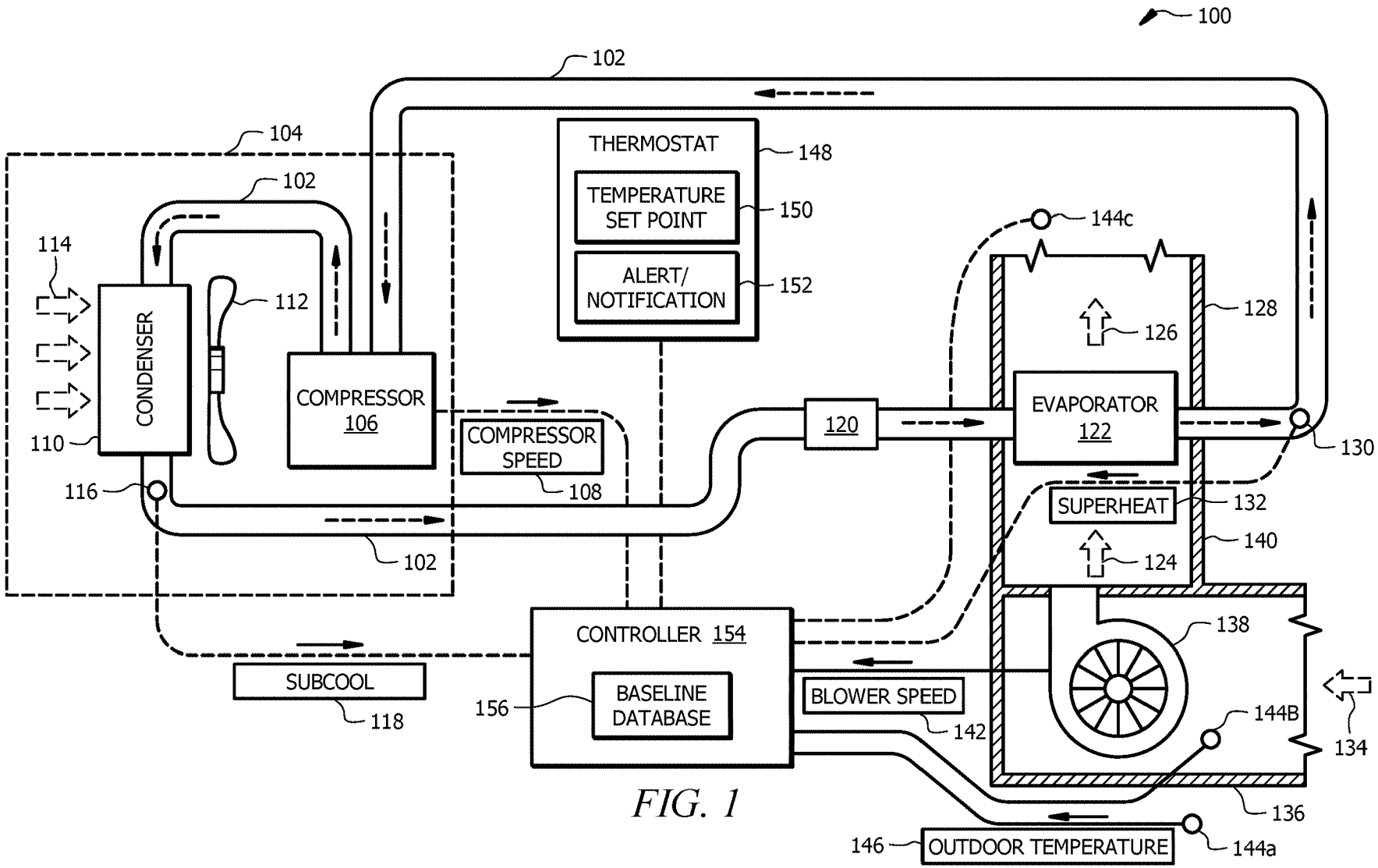
FIG. 1 is a diagram of an example HVAC system configured for the detection of system faults using a baseline database.

FIG. 1 is a schematic diagram of an embodiment of an HVAC system 100 configured for the detection of side faults (e.g., an overcharge or undercharge of working fluid). The HVAC system 100 conditions air for delivery to a conditioned space. The conditioned space may be, for example, a room, a house, an office building, a warehouse, or the like. In some embodiments, the HVAC system 100 is a rooftop unit (RTU) that is positioned on the roof of a building and the conditioned air is delivered to the interior of the building. In other embodiments, portion(s) of the system may be located within the building and portion(s) outside the building. The HVAC system 100 may also be operated as a heat pump by reversing flow of the working fluid through the system such that the condenser 108 acts as an evaporator and the evaporator 122 acts as a condenser. For convenience and clarity, the system 100 is described with respect to the cooling configuration shown in FIG. 1. The system 100 and methods of operation describe herein may also be applied in a heat pump configuration, as appreciated by one of ordinary skill in the art. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, a condensing unit 104, an expansion valve 120, an evaporator 122, a thermostat 148, and a controller 154. The HVAC system 100 is configured to determine possible system faults (e.g., charge faults or component failures) by monitoring properties of the HVAC system, as described in greater detail below. For instance, a subcool signal 118 (described in greater detail below) may be used to determine whether the HVAC system is overcharged or undercharged with working fluid. As another example, a superheat signal 132 (described in greater detail below) may be used to determine whether the HVAC system is operating at or near a steady state condition and/or if the expansion valve 120 is faulty.

The working fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

The condensing unit 104 includes a compressor 106, a condenser 108, and a fan 110. In some embodiments, the condensing unit 104 is an outdoor unit while other components of system 100 may be indoors. The compressor 106 is coupled to the working-fluid conduit subsystem 102 and compresses (i.e., increases the pressure of) the working fluid. The compressor 106 of condensing unit 104 may be a variable speed or multi-stage compressor. A variable speed compressor is generally configured to operate at different speeds to increase the pressure of the working fluid to keep the working fluid moving along the working-fluid conduit subsystem 102. In the variable speed compressor configuration, the speed of compressor 106 can be modified to adjust the cooling capacity of the HVAC system 100. Meanwhile, a multi-stage compressor may include multiple compressors, each configured to operate at a constant speed to increase the pressure of the working fluid to keep the working fluid moving along the working-fluid conduit subsystem 102. In the multi-stage compressor configuration, one or more compressors can be turned on or off to adjust the cooling capacity of the HVAC system 100.

The compressor 106 is in signal communication with the controller 154 using a wired or wireless connection. The controller 154 provides commands or signals to control the operation of the compressor 106 and/or receives signals from the compressor 106 corresponding to a status of the compressor 106. For example, when the compressor 106 is a variable speed compressor, the controller 154 may provide a compressor speed signal 108 to control the compressor speed. When the compressor 106 operates as a multi-stage compressor, the compressor speed signal 108 may correspond to an indication of the number of compressors to turn on and off to adjust the compressor 106 for a given cooling capacity. The controller 154 may operate the compressor 106 in different modes corresponding to load conditions (e.g., the amount of cooling or heating required by the HVAC system 100). The controller 154 is described in greater detail below with respect to FIG. 4.

The condenser 110 is configured to facilitate movement of the working fluid through the working-fluid conduit subsystem 102. The condenser 110 is generally located downstream of the compressor 106 and is configured to remove heat from the working fluid. The fan 112 is configured to move air 114 across the condenser 110. For example, the fan 112 may be configured to blow outside air through the condenser 110 to help cool the working fluid flowing there through. The compressed, cooled working fluid flows from the condenser 110 toward an expansion device 120.

One or more sensors 116 are generally located in, on, or near the condenser 110 to measure properties of the working fluid associated with the condenser 110. In certain embodiments, sensor(s) 116 are positioned and configured to measure a subcool value associated with the condenser 110. The subcool value is generally the temperature difference between the saturation temperature of the working fluid and the temperature of the subcooled liquid working fluid flowing through or in an outlet line of the condenser 110. As shown in the illustrative example of FIG. 1, the sensor(s) 116 may be positioned in the outlet line of the condenser 110 and may include a liquid temperature sensor and a liquid pressure sensor (e.g., for determining a saturation temperature corresponding to the measured pressure). However, the present disclosure contemplates sensor(s) 116 being any appropriate sensor(s) placed in any appropriate location(s) within the HVAC system 100 for determining a subcool value associated with the condenser 110, as appreciated by one of ordinary skill in the art. The sensor(s) 116 are sometimes referred to in the present disclosure as a subcool sensor.

The sensor(s) 116 are in signal communication with the controller 154 using a wired or wireless connection and are configured to send a subcool signal 118 to the controller 154. The subcool signal 118 generally corresponds to the subcool value measured by the sensor(s) 116. For example, the subcool signal 118 may provide a direct indication of the subcool value (e.g., a current or voltage proportional to the measured subcool value) or may be used by the controller 154 to calculate the subcool value (e.g., based on portions of the subcool signal 118 corresponding to measured temperature(s) and/or pressure(s)). In other words, the subcool signal 118 provides subcool values to the controller 154 and/or facilitates the determination of subcool values by the controller 154, based on the subcool signal 118.

The expansion device 120 is coupled to the working-fluid conduit subsystem 102 downstream of the condenser 110 and is configured to remove pressure from the working fluid. In this way, the working fluid is delivered to the evaporator 122 and receives heat from airflow 124 to produce a conditioned airflow 126 that is delivered by a duct subsystem 128 to the conditioned space. In general, the expansion device 120 may be a valve such as an expansion valve or a flow control valve (e.g., a thermostatic expansion valve (TXV) valve) or any other suitable valve for removing pressure from the working fluid while, optionally, providing control of the rate of flow of the working fluid. The expansion device 120 may be in communication with the controller 154 (e.g., via wired and/or wireless communication) to receive control signals for opening and/or closing associated valves and/or provide flow measurement signals corresponding to the rate of working fluid flow through the working fluid subsystem 102.

The evaporator 122 is generally any heat exchanger configured to provide heat transfer between air flowing through the evaporator 122 (i.e., contacting an outer surface of one or more coils of the evaporator 112) and working fluid passing through the interior of the evaporator 122. The evaporator 122 is fluidically connected to the compressor 106, such that working fluid generally flows from the evaporator 122 to the compressor 106.

One or more sensors 130 are generally located in, on, or near the evaporator 122 to measure properties of the working fluid associated with the evaporator 122. In certain embodiments, sensor(s) 130 are positioned and configured to measure a superheat value associated with the evaporator 122. The superheat value is generally the temperature difference between the temperature of superheated vapor working fluid (e.g., the "suction temperature") and the saturation temperature (e.g., the "saturated suction temperature") of the working fluid flowing through the evaporator 122 and/or in an outlet line of the evaporator 122. The sensor(s) 130 may be positioned in the outlet line of the evaporator 122 and may include a suction temperature sensor and a suction pressure sensor (e.g., for determining a saturated suction temperature corresponding to the measured suction pressure). In some embodiments, the sensor(s) 130 may be positioned in the inlet of the compressor and inside the condensing unit 103 (e.g., or outdoor unit). As such, in some embodiments, both sensor(s) 116 and sensor(s) 130 are within the condensing unit 104. the present disclosure contemplates sensor(s) 130 being any appropriate sensor(s) placed in any appropriate location(s) within the HVAC system 100 for determining a superheat value associated with the evaporator 122, as appreciated by one of ordinary skill in the art. The sensor(s) 130 are sometimes referred to in the present disclosure as a superheat sensor.

The sensor(s) 130 are in signal communication with the controller 154 using a wired or wireless connection and are configured to send a superheat signal 132 to the controller 154. The superheat signal 132 generally corresponds to the superheat value measured by the sensor(s) 130. For example, the superheat signal 132 may provide a direct indication of the superheat value (e.g., a current or voltage proportional to the measured superheat value) or may be used by the controller 154 to calculate the superheat value (e.g., based on portions of the superheat signal 132 corresponding to measured temperature(s) and/or pressure(s)). In other words, the superheat signal 132 provides superheat values to the controller 154 and/or facilitates the determination of superheat values by the controller 154, based on the superheat signal 132.

A portion of the HVAC system 100 is configured to move air 124 across the evaporator 122 and out of the duct sub-system 128 as conditioned air 126. Return air 134, which may be air returning from the building, fresh air from outside, or some combination, is pulled into a return duct 140. A suction side of a blower 138 pulls the return air 134. The blower 138 discharges airflow 124 into a duct 140 from where the airflow 128 crosses the evaporator 122 or heating elements (not shown) to produce the conditioned airflow 126. The blower 138 is any mechanism for providing a flow of air through the HVAC system 100. For example, the blower 138 may be a constant-speed or variable-speed circulation blower or fan. Examples of a variable-speed blower include, but are not limited to, belt-drive blowers controlled by inverters, direct-drive blowers with electronic commuted motors (ECM), or any other suitable types of blowers.

The blower 138 is in signal communication with the controller 154 using any suitable type of wired or wireless connection. The controller 154 is configured to provide commands or signals to the blower 138 to control its operation. For example, the controller 154 may be configured to send blower speed signals 142 to the blower 138 to control the speed of the blower 138 and/or to receive blower speed signals 142 associated with a speed of the blower 138. In some embodiments, the controller 154 may be configured to send other commands or signals to the blower 138 to control any other functionality of the blower 138 and/or to receive other operational information (e.g., associated with a status of the blower 138) about the blower 138 as part of signal 142.

The HVAC system 100 includes one or more sensors 144*a-c* in signal communication with the controller 154. The sensors 144*a-c* may include any suitable type of sensor for measuring air temperature as well as other properties of a conditioned space (e.g. a room or building). The sensors 144*a-c* may be positioned anywhere within the conditioned space, the HVAC system 100, and/or the surrounding environment. For example, as shown in the illustrative example of FIG. 1, the HVAC system 100 may include a sensor 144*a* positioned and configured to measure an outdoor air temperature and transmit a corresponding outdoor temperature signal 146 to the controller 154. As another example, the HVAC system 100 may include a sensor 140*b* positioned and configured to measure a return air temperature (e.g., of air flow 134) and/or a sensor 140*c* positioned and configured to measure a supply or treated air temperature (e.g., of air flow 126). In other examples, the HVAC system 100 may include sensors positioned and configured to measure any other suitable type of air temperature (e.g., the temperature of air at one or more locations within the conditioned space).

The HVAC system 100 includes one or more thermostats 148, for example located within the conditioned space (e.g. a room or building). The thermostat 148 is generally in signal communication with the controller 154 using any suitable type of wired or wireless communications. The thermostat 148 may be a single-stage thermostat, a multi-stage thermostat, or any suitable type of thermostat as would be appreciated by one of ordinary skill in the art. The thermostat 148 is configured to allow a user to input a desired temperature or temperature setpoint 150 for a designated space or zone such as a room in the conditioned space. The controller 154 may use information from the thermostat 148 such as the temperature setpoint 150 for controlling the compressor 106 and/or the blower 138. In some embodiments, the thermostat 148 includes a user interface for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for input of the temperature setpoint 150 and display of any alerts and/or notification messages 152 related to the status and/or operation of the HVAC system 100.

As described in greater detail below, the controller 154 is configured to generate and store a baseline database 156, which facilitates the effective detection of faults in the HVAC system 100. The baseline database may be generated based on information from the subcool signal 118, compressor speed signal 108, superheat signal 132, blower speed signal 142, outdoor temperature signal 146, and/or any other information provided to and/or from controller 154. This information may be collected each second, each minute, or at any appropriate frequency. In general, the baseline database 156 includes baseline values associated with normal operation of the HVAC system 100. For example, each baseline value in the baseline database 156 may correspond to a mean subcool value determined for a predefined range of operating characteristics or properties. For example, the predefined range of operating characteristics or properties may correspond to any of ranges of the outdoor temperature, ranges of compressor speeds, and ranges of blower speeds. As such each baseline value may be stored in a "bin" corresponding to these ranges of operational characteristics or properties of the HVAC system 100. FIGS. 2A-B, described in greater detail below, show example tables 200 and 250 of the baseline database 156 where subcool values are stored in bins corresponding to ranges of blower speed, compressor speed, and outdoor temperature.

As described above, in certain embodiments, connections between various components of the HVAC system 100 are wired. For example, conventional cable and contacts may be used to couple the controller 154 to the various components of the HVAC system 100, including, the compressor 106, the subcool sensor 118, the expansion valve 120, the superheat sensor 130, the blower 138, and sensor(s) 144*a-c*. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 154 to other components of the HVAC system 100.

In an example operation of HVAC system 100, the system 100 starts up to provide cooling to an enclosed space based on temperature setpoint 150. For example, in response to the indoor temperature exceeding the temperature setpoint 150, the controller 154 may cause the compressor 106 and the blower 138 to turn on to startup the HVAC system 100. In certain embodiments, during an initial period of time after system startup, the superheat signal 132 is monitored by the controller 154 to determine whether the HVAC system has reached steady state, or approximately steady state, operation. In the context of this example, steady state operation generally refers to a condition in which the superheat value is relatively constant. For example, steady state operation may correspond to conditions in which, after the compressor 106 has operated for a threshold period of time (e.g., 10 minutes or longer), the mean superheat value changes by less than or equal to a threshold percentage (e.g., of about 2%) during the initial period of time after compressor operation is established. As an example, after an initial compressor runtime, a steady state may be determined if the 5-point moving average of the superheat value deviates from the previously determined 5-point moving average of the superheat value by less than or equal to 2%. The controller 154 may also or alternatively determine whether the superheat value is within a range associated with normal system operation. If the superheat value is outside a range defined by a maximum or minimum value and/or if the superheat value fails to reach a steady state, the HVAC system 100 may be under a fault condition. For example, the expansion valve 120 may be faulty. Accordingly, in response to either or both of these conditions, the controller 154 may transmit an alert signal (e.g., to display an alert message on a display of the thermostat 148) indicating a possible system fault.

Once the HVAC system 100 is determined to be operating at a steady state, the controller 154 may generate, during a second time period, the baseline database 156. The baseline database 156 is generated by determining baseline values for different operating conditions (e.g., of compressor speed, outdoor temperature, and/or blower speed). FIGS. 2A and 2B show example tables 200 and 250, respectively, of the baseline database 156. Table 200 includes baseline values that are mean subcool values determined during the second time period for different bins corresponding to ranges of compressor speed and outdoor temperature when the blower speed is in a "normal" speed range (e.g., corresponding to a blower speed equal to or about 400 cubic feet per meter per tonnage of cooling (CFM/ton)). For example, bin 202 of table 200 stores a mean subcool value of 4.63° F., which was determined when the outdoor temperature was in a range from 99-102° F., the compressor speed was in a range from 53-55 Hz, and the blower speed was in the normal speed range. Table 250 includes baseline values that are mean subcool values determined during the second time period for different bins corresponding to ranges of compressor speed and outdoor temperature when the blower speed is in a "low" speed range (e.g., corresponding to a blower speed of less than about 400 CFM/ton). The baseline database 154 may also store a standard deviation for each mean subcool value. The mean and standard deviation of the subcool value for each bin may be used to detect system faults as described in greater detail below.

As shown in the examples of FIGS. 2A-B, the tables 200, 250 do not necessarily include a baseline value for each bin. Some bins may not be populated because the HVAC system 100 may not operate within each of the binned operating condition ranges during the period of time during which the baseline database 156 is generated. However, the present disclosure encompasses the recognition that a baseline value is generally not required for each bin in order for system faults to be detected effectively. For example, under most operating conditions, the system 100 operates during a sufficient portion of time under the same or similar conditions to those experienced while the baseline database 156 was generated. Accordingly, the baseline database 156 generally includes baseline values for bins that are appropriate for system faults to be detected well before the system 100 is damaged and/or before an individual may otherwise be able to identify a fault on his/her own. In some embodiments, global maximum and minimum baseline values may be included in the baseline database 156 (e.g., for the detection of system faults during operation in operating conditions where the corresponding bins do not include baseline values).

In general, the baseline database 156 may include baseline values for different combinations of operating conditions than those shown in the examples of tables 200 and 250. For example, the baseline database 156 may include a single table that includes baseline values for different ranges for any two of blower speed ranges, compressor speed ranges, and outdoor temperature ranges. While the examples of tables 200 and 250 show bins defined by particular ranges of outdoor temperatures and compressor speeds, it should be understood that any other appropriate ranges of these values may be used to define the bins. While FIGS. 2A and 2B show baseline values stored in a series of two-dimensional tables 200 and 250, respectively, it should be understood that the baseline database 156 may store information in any appropriate format (e.g., in a multi-dimensional format). In general, the baseline database 156 may be generated each time the HVAC system 100 starts up (e.g., when the compressor 106 is turned on) or less frequently (e.g., daily, weekly, biweekly, monthly) as appropriate for a given application. For example, a baseline database 156 that was generated during a recent operation of the system 100 may be sufficient for detecting faults during a current operation of the system 100.

Once the baseline database 154 is generated, the HVAC system 100 (e.g., controller 154) periodically determines subcool values based on the subcool signals 118 from the subcool sensor 116. For each determined subcool value, the HVAC system (e.g., controller 154) determines a corresponding compressor speed (e.g., based on compressor speed signal 108), outdoor temperature (e.g., based on outdoor temperature signal 146), and blower speed (e.g., based on blower speed signal 142. The HVAC system 100 (e.g., the controller 154) determines whether each determined subcool value satisfies criteria based on the baseline value for the corresponding bin of the baseline database 156. The corresponding bin is generally the bin associated with the determined outdoor temperature, compressor speed, and blower speed for the subcool value. If the criteria are not satisfied for at least a threshold time (e.g., of 15 minutes or longer), the controller 154 generally determines that the HVAC system is operating under a fault condition. For example, the controller 154 may determine the HVAC system 100 is in an undercharged state when the determined subcool value is less than a temperature range associated with the criteria (e.g., less than the mean subcool value for the bin by greater than or equal to three standard deviations). For example, the controller 154 may determine the HVAC system 100 is in an overcharged state when the determined subcool value is greater than the temperature range defined by the criteria (e.g., greater than the mean subcool value for the bin by greater than or equal to three standard deviations). The controller may then transmit an alert indicating that the HVAC system 100 is operating under the fault condition. For example, the alert may be transmitted for display on the thermostat 148 (e.g., as a notification of a charge imbalance).

Example Method of Operation

Figure 3:
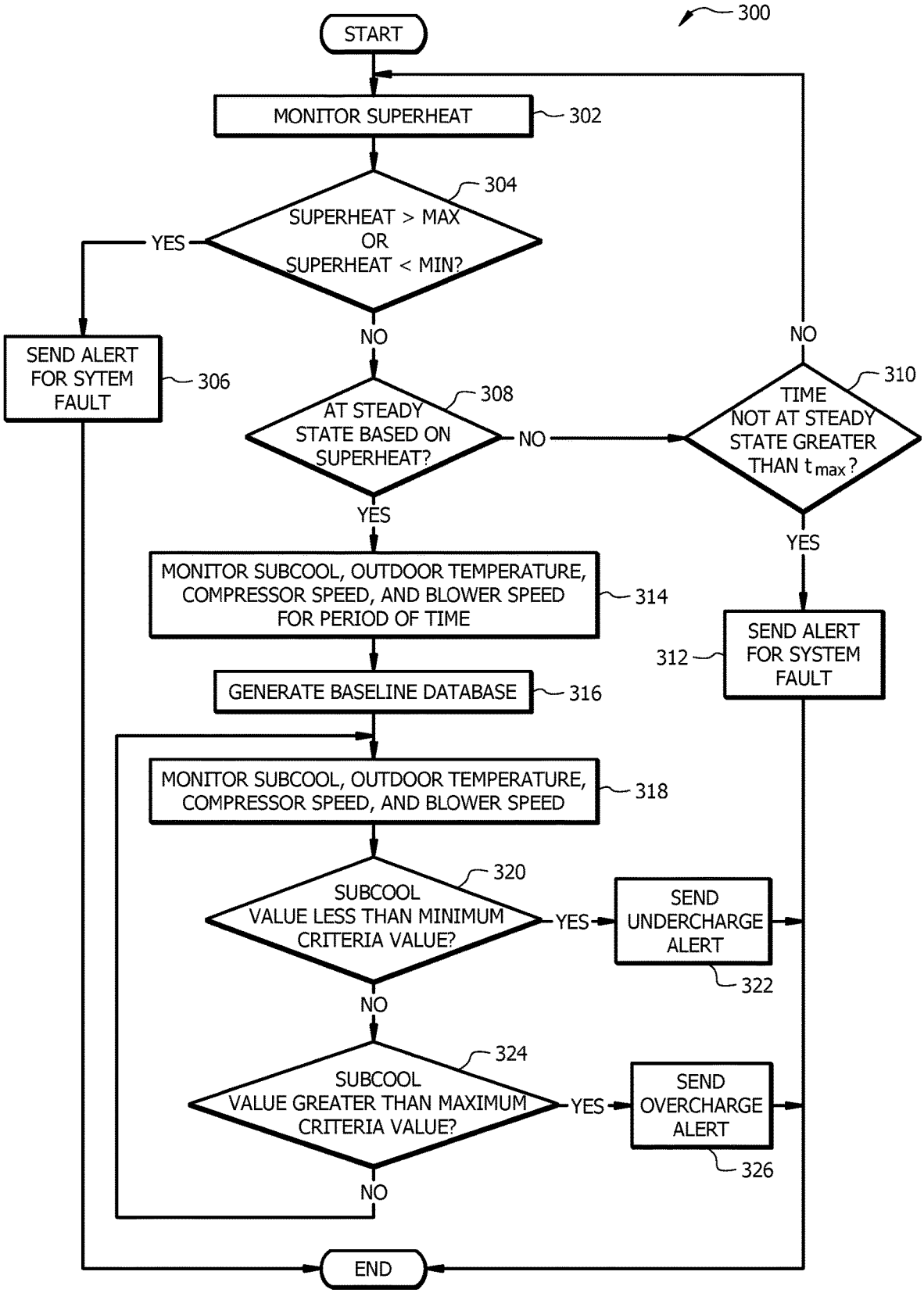
FIG. 3 is a flowchart illustrating an example method of operating the HVAC system of FIG. 1.

FIG. 3 is a flowchart of an example method 300 of operating the HVAC system 100 of FIG. 1. At step 302, the superheat value is monitored during an initial period of time. For example, the controller 154 may periodically (e.g., at regular intervals) receive superheat signal 132 and, based on the value of the superheat signal 132, determine a corresponding superheat value. At step 304, the superheat value may be compared to a maximum and minimum value. If the superheat value is greater than the maximum value or less than the minimum value, an alert may be transmitted at step 306. The alert may correspond to a charge imbalance in the HVAC system 100. Moreover, if the superheat value is greater than the maximum value (e.g., of 26° F.), the controller 154 may determine that the system 100 has experienced a possible loss of charge. For instance, if the superheat value is less than the minimum value (e.g., of 4° F.), the controller 154 may determine that the system 100 may be overcharged. In some embodiments, the system 100 may automatically shut down to prevent damage to the system because of a detected charge imbalance.

If the superheat value is within the range set by the maximum and minimum values at step 304, the measured superheat values are used to determine whether the system 100 is operating at a steady state or an approximate steady state. Criteria for determining steady state operation are described. In some cases, the controller 154 may determine whether the system 100 is operating at steady state by determining a percentage of change of the superheat value (e.g., an average percentage of change during the initial time period) and comparing this percentage of change to a threshold value (e.g., a change of 2% or greater during the initial time period). If the calculated percentage of change is greater than this threshold, the system 100 may be determined to not be at steady state at step 308. The controller 154 may determine whether the system 100 has not been at steady state for more than a maximum time period (e.g., of 15 minutes or longer, or as otherwise appropriate for a given HVAC system 100) at step 310. If the maximum time has not elapsed, the controller 154 continues to monitor the superheat value by returning to step 302. Otherwise, if the maximum time has elapsed, the controller 154 may proceed to step 312 to send an alert related to the failure to reach steady state within the time interval at step 312. This alert may be associated with a system fault (e.g., a charge imbalance and/or a faulty expansion valve 120).

If the calculated percentage of change is less than the threshold value, the system 100 may be determined to be at steady state at step 308, and the controller 154 proceeds to step 314 to monitor the subcool value, outdoor temperature, compressor speed, and blower speed. For instance, the subcool value may be determined based on the subcool signal 118. The compressor speed may be determined based on the compressor speed signal 108. The blower speed may be determined based on the blower speed signal 142, and the outdoor temperature may be determined based on the outdoor temperature signal 146.

At step 316, the subcool values, compressor speeds, outdoor temperatures, and blower speeds are used to generate the baseline database 156. The baseline database may be generated as these values are determined by the controller 154 during a data collection time interval (i.e., a period of time during which baseline data are collected). In some embodiments, a given bin of the database 156 has a predetermined number of datapoints is collected to determine a baseline value that corresponds to a saturated mean. The predetermined number of datapoints needed to reach a saturated mean may be determined statistically based on a standard deviation of the data points for the bin, a width around the mean value calculated for the bin, and a confidence interval for the mean. In other words, in these embodiments, the baseline value for a given bin may be established after a statistically determined threshold number of datapoints are collected for the bin. The database 156 may alternatively be generated based on the determined information after the collection time interval has completed or at intermediate times during the collection time interval.

At step 318, after the baseline database 156 is generated, the controller continues to monitor subcool values, compressor speeds, outdoor temperatures, and blower speeds in the same or a similar manner to that described above with respect to step 314. At step 320, each determined subcool value is compared to the baseline value (e.g., the mean subcool value) for the corresponding bin. For example, if a subcool value of 4.55° F. was determined with a corresponding outdoor temperature of 100° F., a compressor speed of 53 Hz, and blower speed in a normal range, the controller may access baseline information from table 200 of FIG. 2A to compare the determined subcool value of 4.55° F. to the mean subcool value of 4.63° F. in bin 202 (i.e., the bin associated with the determined blower speed, compressor speed, and outdoor temperature for this subcool value).

If, at step 320, the subcool value is less than a baseline criteria range for a predefined period of time (e.g., of 30 minutes or less, e.g., of about 15 minutes), the HVAC system 100 is determined to be operating under fault conditions. For example, if the subcool value is less than the baseline value minus three standard deviations, the system 100 may be determined to be operating under fault conditions corresponding to an undercharge of working fluid. For instance, for a determined subcool value of 4.55° F., a mean subcool value of 4.63° F., and a corresponding standard deviation of 0.02° F., the system 100 would be determined to be operating in an undercharged state (i.e., because 4.55° F. <4.57° F.=4.63° F.−3×0.02° F.). At step 322, if the subcool value is less than the baseline criteria range, an alert may be transmitted at step 322 indicating that the system 100 is overcharged with working fluid.

If, at step 324, the subcool value is greater than the baseline criteria range associated with the baseline criteria for a predefined period of time (e.g., of 15 minutes or greater), the HVAC system 100 is determined to be operating under fault conditions. For example, if the subcool value is greater than the baseline value plus three standard deviations, the system 100 may be determined to be operating under fault conditions corresponding to an overcharge of working fluid. At step 326, if the subcool value is greater than the baseline criteria range, an alert may be transmitted indicating an undercharge of working fluid at step 326. Otherwise, if the baseline criteria range is satisfied at steps 320 and 324, the controller 154 returns to step 318 to continue monitoring sub cool values, compressor speeds, outdoor temperatures, and blower speeds.

In general, if a determined subcool value corresponds to a bin that lacks a baseline value entry (e.g., as shown in bin 204 of FIG. 2), the controller 154 generally pauses method 300 and does not determine that a system fault has occurred. Under most operating conditions, the system 100 will operate during a sufficient portion of time under the conditions for which bins include a baseline value, such that system faults may still be detected before damage to the system 100. In some embodiments, a global maximum and minimum subcool value is defined such that if the subcool value is greater than the global maximum value or less than the global minimum value for the threshold time period, the system 100 is determined to be operating under fault conditions.

Modifications, additions, or omissions may be made to method 300 depicted in FIG. 3. Method 300 may include more, fewer, or other steps. For example, steps may be performed in parallel or in any suitable order. While at times discussed as controller 154, HVAC system 100, or components thereof performing the steps, any suitable HVAC system or components of the HVAC system may perform one or more steps of the method.

Example Controller

Figure 4:
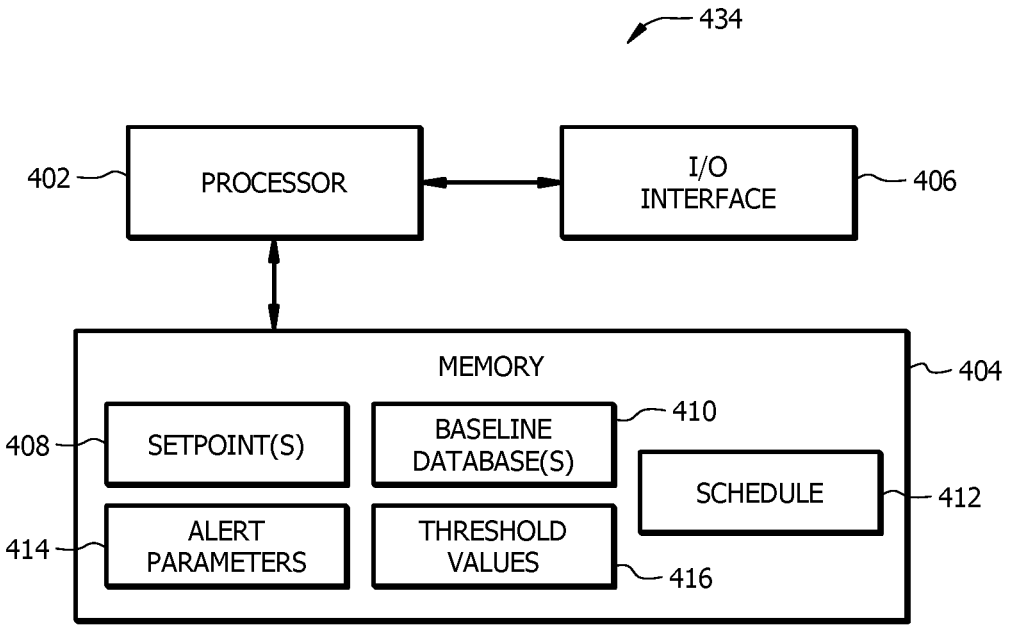
FIG. 4 is a diagram of the controller of the example HVAC system of FIG. 1.

FIG. 4 is a schematic diagram of an embodiment of the controller 154. The controller 154 includes a processor 402, a memory 404, and an input/output (I/O) interface 406.

The processor 402 includes one or more processors operably coupled to the memory 404. The processor 402 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 404 and controls the operation of HVAC system 100. The processor 402 may be a programmable logic device, a microcontroller, a micro-processor, or any suitable combination of the preceding. The processor 402 is communicatively coupled to and in signal communication with the memory 404. The one or more processors are configured to process data and may be implemented in hardware or software. For example, the processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory 404 and executes them by directing the coordinated operations of the ALU, registers, and other components. The processor may include other hardware and software that operates to process information, control the HVAC system 100, and perform any of the functions described herein (e.g., with respect to FIG. 3). The processor 402 is not limited to a single processing device and may encompass multiple processing devices. Similarly, the controller 154 is not limited to a single controller but may encompass multiple controllers.

The memory 404 includes one or more disks, tape drives, or solid-state drives, and may be used as an over-flow data storage device, to store programs when such programs are selected for execution, and to store instructions and data that are read during program execution. The memory 404 may be volatile or non-volatile and may include ROM, RAM, ternary content-addressable memory (TCAM), dynamic random-access memory (DRAM), and static random-access memory (SRAM). The memory 404 is operable to store one or more setpoints 408, one or more baseline databases 410, schedule 412, alert parameters 414, and threshold values 416.

The one or more setpoints 408 include but are not limited to the setpoint 150 of FIG. 1. In general, the setpoint(s) 408 include any temperature, humidity, or other setpoints used to configure cooling or heating functions of the HVAC system 100. The one or more baseline databases 410 include but are not limited to the baseline database 156 described above with respect to FIG. 1. For example, in addition to the baseline database 156, the baseline database(s) 410 may include previously generated baseline databases. In some embodiments, gradual changes in baseline operation may be determined from the historical record provided by the baseline database(s) 410. The schedule 412 includes any information and/or parameters used to schedule function of the HVAC system 100. For instance, certain scheduling parameters of the schedule 412 may be configured via the thermostat 148 (e.g., to schedule when the HVAC system turns on/off). The schedule 412 may also include scheduling parameters for how frequently a baseline database 154 should be generated (e.g., upon each startup, daily, weekly, etc.). The schedule 412 may also include the time intervals (e.g., the periods of time) used to implement the methods described herein. For example, the time intervals may correspond to the initial period of time for establishing a steady state and the period of time for generating the baseline database 154. The alert parameters 414 include any information for providing the alerts and/or notification described herein. For instance, the alert parameters 414 may include information for formatting alerts for display in thermostat 148. The threshold values 416 include any of the thresholds used to implement the functions described herein including the predefined threshold time during which the baseline criteria are not satisfied before a system fault is detected.

The I/O interface 406 is configured to communicate data and signals with other devices. For example, the I/O interface 406 may be configured to communicate electrical signals with components of the HVAC system 100 including the compressor 106, the subcool sensor 116, the expansion valve 120, the superheat sensor 130, the blower 138, sensors 144*a-c*, and the thermostat 148. The I/O interface may receive, for example, compressor speed signals 108, subcool signals 118, superheat signals 132, blower speed signals 142, outdoor temperature signals 146, thermostat calls, temperature setpoints, environmental conditions, and an operating mode status for the HVAC system 100 and send electrical signals to the components of the HVAC system 100. The I/O interface 406 may include ports or terminals for establishing signal communications between the controller 154 and other devices. The I/O interface 406 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation and air conditioning (HVAC) system comprising:

a compressor configured to receive refrigerant and direct the refrigerant to flow through a refrigerant conduit subsystem;

a condenser configured to receive the refrigerant and cool the refrigerant flowing therethrough;

a blower configured to provide a flow of air through the HVAC system;

a subcool sensor configured to provide a subcool signal corresponding to a subcool value associated with the condenser, wherein the subcool value corresponds to a temperature difference between a saturated refrigerant and a subcooled refrigerant associated with the condenser;

an outdoor temperature sensor configured to provide an outdoor temperature signal corresponding to a temperature of an outdoor space; and a controller communicatively coupled to the subcool sensor, the outdoor temperature sensor, the compressor, and the blower, the controller configured to:

for a first period of time:

periodically determine subcool values based on the subcool signal provided by the subcool sensor;

determine, for each determined subcool value, a corresponding compressor speed, outdoor temperature, and blower speed;

generate a baseline database with baseline values associated with normal operation of the HVAC system, wherein each baseline value corresponds to a mean subcool value determined for a corresponding bin of the baseline database, wherein each bin corresponds to a predefined range of outdoor temperatures, a predefined range of compressor speeds, and a predefined range of blower speeds;

following the first period of time:

periodically determine subcool values based on the subcool signal provided by the subcool sensor;

determine, for each determined subcool value, the corresponding compressor speed, outdoor temperature, and blower speed;

for each determined subcool value, determine whether the subcool value satisfies a criteria, wherein the criteria is based on the baseline value for the bin associated with the outdoor temperature, compressor speed, and blower speed corresponding to the subcool value;

responsive to a determination that the criteria are not satisfied for at least a threshold time, determine that the HVAC system is operating under a fault condition; and transmit an alert comprising an indication that the HVAC system is operating under the fault condition.

2. The HVAC system of claim 1, wherein the subcool sensor comprises one or both of one or more temperature sensors and one or more pressure sensors located in or on an outlet line of the condenser.

3. The HVAC system of claim 1, wherein:

the baseline database further comprises, for each baseline value, a corresponding standard deviation of the mean subcool value; and the controller is further configured to determine whether at least one of the determined subcool value satisfies the criteria for a given bin of the baseline database by determining whether the at least one of the determined subcool value is within three standard deviations from the mean subcool value for the bin.

4. The HVAC system of claim 3, wherein the controller is further configured to:

determine the HVAC system is in an overcharged state when at least one of the determined subcool value is greater than the mean subcool value by greater than or equal to three standard deviations for the threshold time; and determine the HVAC system is in an undercharged state when the at least one of the determined subcool value is less than the mean subcool value by greater than or equal to three standard deviations for the threshold time.

5. The HVAC system of claim 1, further comprising:

an evaporator located downstream from the condenser, the evaporator configured to receive the refrigerant and transfer heat to the received refrigerant; and a superheat sensor configured to provide a superheat signal corresponding to a superheat value associated with the evaporator of the HVAC system, wherein the superheat values corresponds to a temperature difference between a superheated refrigerant and a saturated refrigerant associated with the evaporator; and wherein the controller is further communicatively coupled to the superheat sensor and is further configured to, prior to the first period of time:

following an initial compressor runtime, periodically determine, for a second period of time, superheat values based on the superheat signal provided by the superheat sensor; and determine, based on the determined superheat values, whether the HVAC system is operating at steady state during the second period of time.

6. The HVAC system of claim 5, wherein the controller is configured to determine whether the HVAC system is operating at steady state by:

determining a percentage of change of the superheat values determined during the second period of time; and determining that the HVAC system is operating at steady state if the determined percentage of change is less than a predefined value.

7. The HVAC system of claim 5, wherein the superheat sensor comprises one or both of one or more temperature sensors and one or more pressure sensors located in or on an outlet line of the evaporator.

8. The HVAC system of claim 1, wherein the threshold time is 30 minutes or less.

9. A method of operating an HVAC system, the method comprising:

for a first period of time:

periodically determining subcool values associated with a condenser of the HVAC system, based on a subcool signal provided by a subcool sensor of the HVAC system;

determining, for each determined subcool value, a corresponding compressor speed associated with a compressor of the HVAC system, outdoor temperature, and blower speed associated with a blower of the HVAC system;

generating a baseline database with baseline values associated with normal operation of the HVAC system, wherein each baseline value corresponds to a mean subcool value determined for a corresponding bin of the baseline database, wherein each bin corresponds to a predefined range of outdoor temperatures, a predefined range of compressor speeds, and a predefined range of blower speeds;

following the first period of time:

periodically determining subcool values based on the subcool signal provided by the subcool sensor;

determining, for each determined subcool value, the corresponding compressor speed, outdoor temperature, and blower speed;

for each determined sub cool value, determining whether the sub cool value satisfies a criteria, wherein the criteria is based on the baseline value for the bin associated with the outdoor temperature, compressor speed, and blower speed corresponding to the subcool value;

responsive to determining that the criteria are not satisfied for at least a threshold time, determining that the HVAC system is operating under a fault condition; and transmitting an alert comprising an indication that the HVAC system is operating under the fault condition.

10. The method of claim 9, wherein the subcool sensor comprises one or both of one or more temperature sensors and one or more pressure sensors located in or on an outlet line of the condenser.

11. The method of claim 9, wherein:

the baseline database further comprises, for each baseline value, a corresponding standard deviation of the mean subcool value; and the method further comprises determining whether at least one of the determined subcool value satisfies the criteria for a given bin of the baseline database by determining whether the determined subcool value is within three standard deviations from the at least one of the mean subcool value for the bin.

12. The method of claim 11, further comprising:

determining the HVAC system is in an overcharged state when at least one of the determined subcool value is greater than the mean subcool value by greater than or equal to three standard deviations for the threshold time; and determining the HVAC system is in an undercharged state when the at least one of the determined subcool value is less than the mean subcool value by greater than or equal to three standard deviations for the threshold time.

13. The method of claim 9, further comprising:

periodically determining, for a second period of time, superheat values based on a superheat signal provided by a superheat sensor of the HVAC system, wherein the superheat sensor is configured to provide a superheat signal corresponding to a superheat value associated with an evaporator of the HVAC system; and determining, based on the determined superheat values, whether the HVAC system is operating at steady state during the second period of time.

14. The method of claim 13, wherein determining whether the HVAC system is operating at steady state comprises:

determining a percentage of change of the superheat values determined during the second period of time; and determining that the HVAC system is operating at steady state if the determined percentage of change is less than a predefined value.

15. The method of claim 13, wherein the superheat sensor comprises one or both of one or more temperature sensors and one or more pressure sensors located in or on an outlet line of the evaporator.

16. A controller of an HVAC system, the controller configured to:

for a first period of time:

periodically determine subcool values associated with a condenser of the HVAC system, based on a subcool signal provided by a subcool sensor of the HVAC system;

determine, for each determined subcool value, a corresponding compressor speed associated with a compressor of the HVAC system, outdoor temperature, and blower speed associated with a blower of the HVAC system;

generate a baseline database with baseline values associated with normal operation of the HVAC system, wherein each baseline value corresponds to a mean subcool value determined for a corresponding bin of the baseline database, wherein each bin corresponds to a predefined range of outdoor temperatures, a predefined range of compressor speeds, and a predefined range of blower speeds;

following the first period of time:

periodically determine subcool values based on the subcool signal provided by the subcool sensor;

determine, for each determined subcool value, the corresponding compressor speed, outdoor temperature, and blower speed;

for each determined subcool value, determine whether the subcool value satisfies a criteria, wherein the criteria is based on the baseline value for the bin associated with the outdoor temperature, compressor speed, and blower speed corresponding to the subcool value;

responsive to determining that the criteria are not satisfied for at least a threshold time, determine that the HVAC system is operating under a fault condition; and transmit an alert comprising an indication that the HVAC system is operating under the fault condition.

17. The controller of claim 16, wherein the subcool sensor comprises one or both of one or more temperature sensors and one or more pressure sensors located in or on an outlet line of the condenser.

18. The controller of claim 16, wherein:

the baseline database further comprises, for each baseline value, a corresponding standard deviation of the mean subcool value; and the controller is further configured to determine whether at least one of the determined subcool value satisfies the criteria for a given bin of the baseline database by determining whether the at least one of the determined subcool value is within three standard deviations from the mean subcool value for the bin.

19. The controller of claim 18, the controller further configured to:

determine the HVAC system is in an overcharged state when at least one of the determined subcool value is greater than the mean subcool value by greater than or equal to three standard deviations for the threshold time; and determine the HVAC system is in an undercharged state when the at least one of the determined subcool value is less than the mean subcool value by greater than or equal to three standard deviations for the threshold time.

20. The controller of claim 16, the controller further configured to:

periodically determine, for a second period of time, superheat values based on a superheat signal provided by a superheat sensor of the HVAC system, wherein the superheat sensor is configured to provide a superheat signal corresponding to a superheat value associated with an evaporator of the HVAC system; and determine, based on the determined superheat values, whether the HVAC system is operating at steady state during the second period of time.

* * * * *